US006359227B1

(12) United States Patent
Oh et al.

(10) Patent No.: US 6,359,227 B1
(45) Date of Patent: Mar. 19, 2002

(54) FUSIBLE LINK FOR CABLE ASSEMBLY AND METHOD OF MANUFACTURING SAME

(75) Inventors: Seibang Oh, Elk Grove Village; Cesario Herbias, Calumet City; Demetrios Thanopoulos, Arlington Heights, all of IL (US); Jozef Philoteus Maria Johannes Jaspar, Tiel (NL)

(73) Assignee: Littelfuse, Inc., Des Plaines, IL (US)

( * ) Notice: Subject to any disclaimer, the term of this patent is extended or adjusted under 35 U.S.C. 154(b) by 0 days.

(21) Appl. No.: 09/519,981

(22) Filed: Mar. 7, 2000

(51) Int. Cl.[7] ..... H01R 4/00
(52) U.S. Cl. ..... 174/84 R
(58) Field of Search ..... 174/84 R, 84 C, 174/74 R, 79, 35 C; 439/893, 621

(56) References Cited

U.S. PATENT DOCUMENTS

| | | | | | |
|---|---|---|---|---|---|
| 1,175,103 | A | | 3/1916 | Williams | |
| 1,579,596 | A | | 4/1926 | Cote | |
| 2,414,865 | A | | 1/1947 | Genter | |
| 2,872,501 | A | | 2/1959 | McMahon | |
| 3,422,213 | A | | 1/1969 | Webb | |
| 3,601,737 | A | | 8/1971 | Baird et al. | |
| 3,766,307 | A | | 10/1973 | Andrews, Jr. | |
| 3,766,509 | A | | 10/1973 | Cameron | |
| 4,280,748 | A | * | 7/1981 | McHenney et al. | 339/147 R |
| 4,308,515 | A | | 12/1981 | Rooney et al. | |
| 4,333,701 | A | | 6/1982 | Schick | |
| 4,365,226 | A | | 12/1982 | Barry et al. | |
| 4,391,485 | A | * | 7/1983 | Urani | 339/191 S |
| 4,679,877 | A | | 7/1987 | Ahroni | |
| 4,734,059 | A | * | 3/1988 | Melugin | 439/621 |
| 4,831,353 | A | | 5/1989 | Gaia et al. | |
| 4,880,943 | A | | 11/1989 | Kuzuno et al. | |
| 4,958,426 | A | | 9/1990 | Endo et al. | |
| 5,018,991 | A | * | 5/1991 | Katz et al. | 439/621 |
| 5,162,773 | A | | 11/1992 | Shiozaki | |
| 5,241,134 | A | | 8/1993 | Yoo | |
| 5,298,877 | A | | 3/1994 | Gurevich et al. | |
| 5,304,740 | A | | 4/1994 | Bozell et al. | |
| 5,329,065 | A | | 7/1994 | Marney et al. | |
| 5,345,210 | A | * | 9/1994 | Swensen et al. | 337/163 |
| 5,391,836 | A | | 2/1995 | Bortas et al. | |
| 5,481,239 | A | * | 1/1996 | Di Troia | 337/206 |
| 5,493,069 | A | | 2/1996 | Conti | |
| 5,509,202 | A | * | 4/1996 | Abdow | 29/871 |
| 5,591,366 | A | | 1/1997 | Schmidt et al. | |
| 6,046,665 | A | * | 4/2000 | Oh et al. | 337/191 |

* cited by examiner

*Primary Examiner*—Dean A. Reichard
*Assistant Examiner*—William H. Mayo, III
(74) *Attorney, Agent, or Firm*—Bell, Boyd & Lloyd LLC

(57) ABSTRACT

A fusible link for a cable assembly is provided. The fusible link has a link segment having a first member extending transversely from the link segment, and a second member extending transversely from the link segment. A first end of the link segment engaging a first cable of the cable assembly, and a second end of the link segment engaging a second cable of the cable assembly. A method of manufacturing the fusible link is also provided.

30 Claims, 2 Drawing Sheets

FUSIBLE LINK FOR CABLE ASSEMBLY AND METHOD OF MANUFACTURING SAME

TECHNICAL FIELD

The invention relates to the field of electrical protection, and is particularly directed to a fusible link for protecting electrical devices.

BACKGROUND OF THE INVENTION

Automobiles are increasingly reliant on electronic controls and engine management systems. As a result of these controls and systems, modern automobiles are much more dependable than prior autos, which instead used more vulnerable mechanical systems. Although the hardware embodying the electronic controls and systems is rather dependable, the failure of the means for directly or indirectly bringing electrical current to such hardware continues to be a rare but, nevertheless, significant source of automotive breakdowns. An automotive breakdown, especially in a deserted area or on a very busy high-speed road, is obviously a safety hazard to the automobile and its passengers.

One specific type of failure in prior art means can lead to an even more hazardous condition than automotive breakdown. The failure results when the junctions between the fusible link and the cables loosen, causing a high resistance between the fusible link and cable. The increased resistance leads to high temperatures in these regions. One cause of the failure at the connection of the fusible link and the cable is due to the flexibility of the fusible link. If the fusible link is not sufficiently rigid it may twist and bend during use of the cable assembly, thereby causing the connection between the fusible link and the cable to fail. Under certain conditions the increased temperatures can reach sufficiently high levels to split the insulation on the conventional copper-wire fusible links, initiating an engine compartment fire that can quickly destroy the automobile and endanger its occupants.

U.S. Pat. No. 5,591,366 issued to Schmidt et al. discloses a series of protective coverings over a heating wire connected to a power wire. The heating wire is connected in series to an electrical pin which directly joined to a fuse wire. The fuse wire is then joined to the power wire. Two opposing metal caps are bonded on their inner surfaces to a ceramic tube to form a hermetically sealed shell surrounding the junctions between the fuse wire and pin, and between the fuse wire and power wire. Then, a heat shrinkable tubing is used to grip the caps and ceramic tubing, encasing the fuse area.

Like other prior art devices, the disclosure of U.S. Pat. No. 5,591,366 does not solve the problem of protecting failure at the junctions of the fusible link.

Accordingly, a fusible link for a cable assembly in accordance with the present invention eliminates the drawbacks of the prior art devices described above.

SUMMARY OF THE INVENTION

According to one aspect of the present invention, a fusible link is provided for a cable assembly. The fusible link has a link segment having a first member extending transversely from the link segment, and a second member extending transversely from the link segment. The link segment is adapted to be electrically connected to first and second cables of the cable assembly.

According to another aspect of the present invention, the link segment has a first end and a second end, a first surface and a second surface, and a first side and a second side. The first end of the link segment is adapted to engage the first cable of the cable assembly and the second end of the link segment is adapted to engage the second cable of the cable assembly to electrically connect the fusible link with the first and second cables. The first member extends from the first side of the link segment and the second member extends from the second side of the link segment. The first and second members are transverse to the link segment.

According to another aspect of the present invention, the first member extends in a first direction transverse from the link segment, and the second member extends in a second direction from the link segment. In one embodiment, the second direction is substantially the same direction as the first direction. In another embodiment the second direction is substantially the opposite as the first direction.

According to another aspect of the present invention, the link segment is substantially planar and a plurality of apertures extend through the link segment. The fusible link may be made of a first conductive material that is the same as the conductive material as the first and second cables, and a second conductive material having a lower melting temperature than the first conductive material may be deposited on the link segment.

According to another aspect of the present invention, a method of manufacturing the fusible link is provided. The method includes providing a strip of conductive material having a first surface and a second surface. An aperture is created in the conductive material. The aperture extends from the first surface of the conductive material to the second surface of the conductive material. Additionally, transverse members are created on the fusible link.

According to another aspect of the present invention, the step of creating the transverse members comprises bending a first side of the strip of conductive material at an angle to the first surface to create a first transverse member, and bending the second side of the conductive material at an angle to the first surface to create a second transverse member.

According to another aspect of the present invention, a method of manufacturing a plurality of fusible links is provided. The method includes dicing the strip of conductive material into individual fusible links prior to creating the transverse members.

According to yet another aspect of the present invention, an additional step is provided including adding a second conductive material having a lower melting temperature than the first conductive material on one of the first and second surfaces of the fusible link. The second conductive material is added adjacent the aperture in the conductive material.

Other features and advantages of the invention will be apparent from the following specification taken in conjunction with the following drawings.

BRIEF DESCRIPTION OF THE DRAWINGS

To understand the present invention, it will now be described by way of example, with reference the accompanying drawings in which.

DETAILED DESCRIPTION OF THE PREFERRED EMBODIMENT

Figure 1:
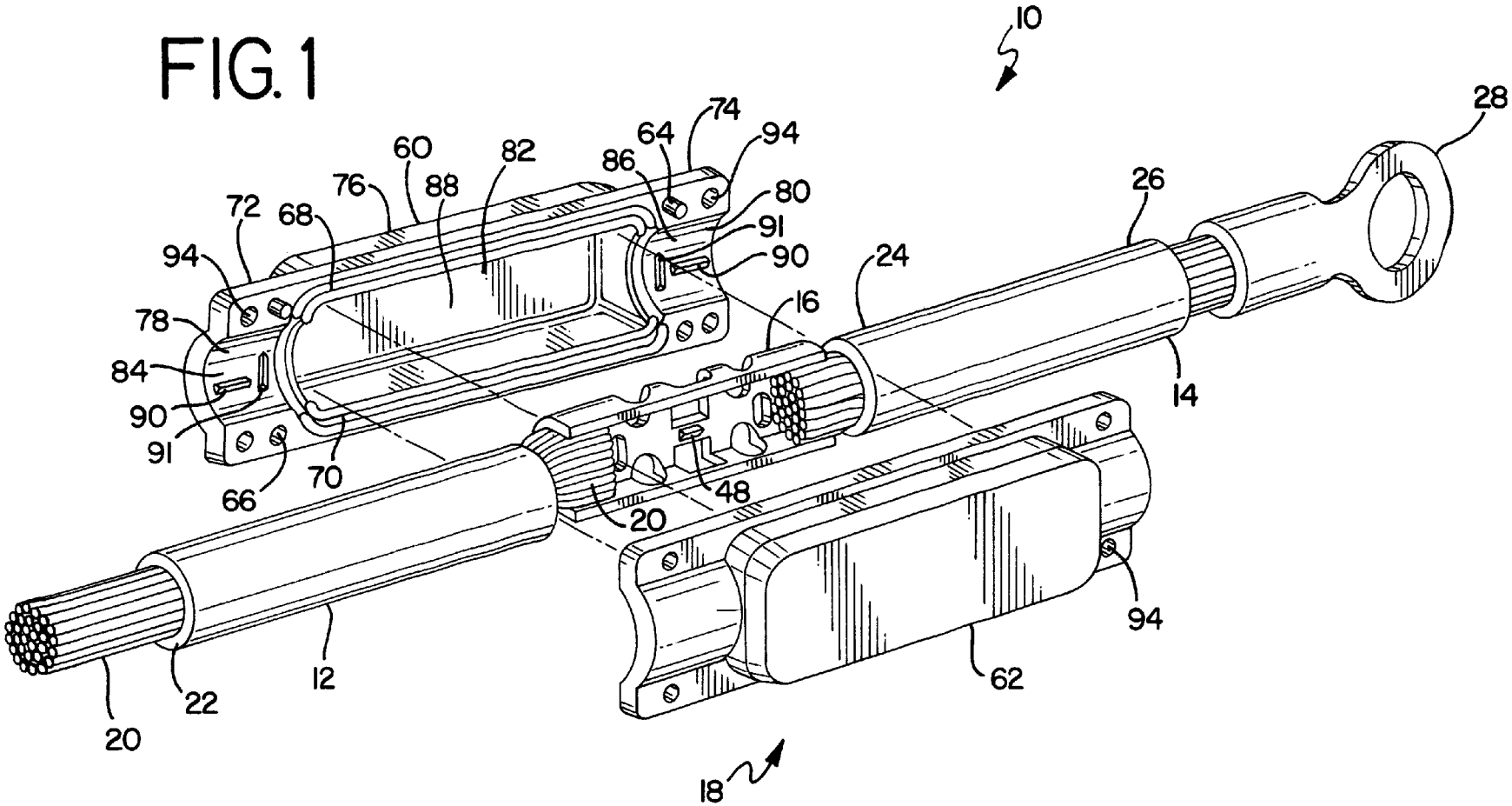
FIG. 1 is an exploded perspective view of the cable assembly, including a protective housing andthe fusible link of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now in detail to the Figures, and initially to FIG. 1, there is shown a preferred embodiment of the fusible link 16 of the present invention. The fusible link 16 is generally utilized with a cable assembly 10, including a first cable 12 and a second cable 14 connected to ends of the fusible link 16, and a protective housing 18 encasing the fusible link 16. The present fusible link 16 is an improvement over prior art fusible links in that it provides a rigid member to electrically connect the first and second cables 12, 14. Thus, the present invention offers stability and safety features previously not available with prior fusible links.

As shown in FIG. 1, the first and second cables 12,14 are conventional insulated electrical cables and are generally comprised of a core of a plurality of elongated strands of wires 20 surrounded by a protective insulation layer 22, such as polyethylene. Nonetheless, a solid wire or cable could be employed as the core for the present invention in lieu of a stranded cable. The cable core 20 is made of a first material, preferably a conductive metal, and more preferably copper. Each of the cables 12,14 generally have a first or proximal end 24, and a second or distal end 26. A portion of the protective covering 22 or insulation adjacent the first or proximal end 24 of each cable is removed or stripped away from the cable. Preferably, approximately a ½" portion of insulating covering 22 is removed from the first end 24 of the cable. Thus, the end portion of the cables or wires extends past their respective protective coverings 22.

In the preferred embodiment of the present invention the first cable 12 is made of 6 gauge wire. The first cable 12 may have a terminal 28 at the second or distal end 26 of the cable for connecting the cable to a power source (not shown). The second cable 14 is similarly made of a 6 gauge wire. The second cable 14 may have a terminal 28 at the second or distal end 26 of the cable for connecting to a desired electrical device (not shown) such as the starter of an automobile. Even though a 6 gauge wire is utilized in the preferred embodiment, much larger and much smaller gauge wires, for example, from 10 gauge up to at least 2 gauge or larger, may be used as either the first cable, the second cable, or both the first and second cables. Furthermore, it is understood that the gauge thickness of the first cable could be different from the gauge thickness of the second cable.

The fusible link of the preferred embodiment is illustrated in FIGS. 1, and 4–7. The fusible link 16 is adapted to be electrically connected to the first and second cables 12,14 of the cable assembly. The fusible link 16 comprises a link segment 17 having a first end 30 and a second end 32, a first surface 36 and a second surface 38, and a first side 39 and a second side 41. Generally, the link segment 17 is substantially planar. The first end 30 of the link segment 17 is adapted to engage the first cable 12, and the second end 32 of the link segment 17 is adapted to engage the second cable 14. Further, first and second members 40,42 extend from the link segment. In the preferred embodiments of the present invention, the first member 40 extends from the first side 39 of the link segment 17, and the second member 42 extends from the second side 41 of the link segment 17. The first and second members 40,42 are transverse to the link segment 17. The transverse members 40,42 of the fusible link 16 provide superior bending strength and rigidity for the fusible link 16.

Figure 4:
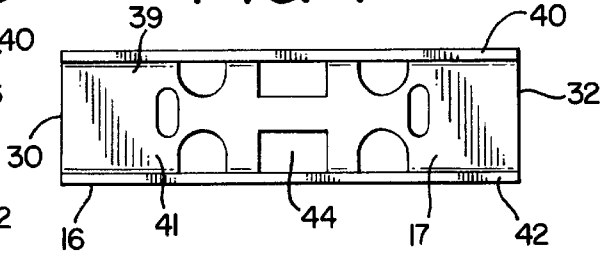
FIG. 4 is a top plan view of the fusible link of FIG. 1.
Figure 5:
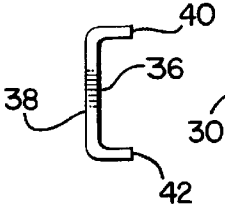
FIG. 5 is a side elevation view of the fusible link of FIG. 4.

One preferred embodiment of the fusible link of the present invention is illustrated in FIGS. 4 and 5. In this embodiment the first transverse member 40 extends in a first direction transverse from the link segment 17, and the second transverse member 42 extends in a second direction which is substantially the same direction as the first member 40. The first member 40 and the second member 42 extend from or are adjacent one of the surfaces 36,38 of the link segment. As shown in FIG. 4, the first member 40 extends from the first surface 36 adjacent the first side 39 thereof, and the second member 42 extends from the first surface 36 adjacent the second side 41 thereof. Thus, both the first and second members 40,42 extend away from the link segment 17 in the same direction (away from and adjacent to the first surface), and the fusible link 16 of this embodiment is approximately U-shaped. As shown in FIG. 5, the first and second members 40,42 are substantially perpendicular to the link segment 17. The transverse members 40,42, however, need not be at exact right angles (i.e., at 90°) to the link segment 17, and are generally within ±30° of 90°.

The improved rigidity in the fusible link 16 is provided from the transverse portion of a member adjacent the link segment 17 of the fusible link 16. Accordingly, any angle that the first and second members 40,42 depend from the link segment 17 provides improved rigidity. Preferably, the first and second members 40,42 extend at least at a 30° angle to the link segment 17. More preferably, the first and second members 40,42 extend at least at a 45° angle to the link segment 17. Most preferably, the first and second members 40,42 extend at an angle between 45° and 90° to the link segment 17.

Figure 6:
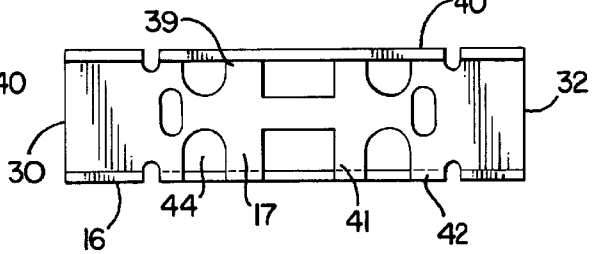
FIG. 6 is a top plan view of another embodiment of the fusible link.
Figure 7:
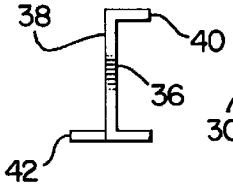
FIG. 7 is a side elevation view of the fusible link of FIG. 6.

Another preferred embodiment of the fusible link of the present invention is illustrated in FIGS. 6 and 7. In this embodiment the first transverse member 40 extends in a first direction transverse from the link segment 17, and the second transverse member 42 extends in a second direction which is substantially the opposite direction as the first member 40. Thus, the first member 40, the link segment 17, and the second member 42 form the shape of an "S" or "Z." As shown in FIG. 7, the first member 40 extends from or adjacent the first surface 36 of the link segment 17 adjacent the first side 39 thereof, and the second member 42 extends from or adjacent the second surface 38 of the link segment 17 adjacent the second side 41 thereof. Like the embodiment illustrated in FIGS. 4 and 5, the first and second members 40,42 are substantially perpendicular to the link segment 17. Also like the above embodiment, the transverse members 40,42 need not be at exact right angles (i.e., at 90°) to the link segment 17, but are generally within ±30° of 90°.

The fusible link 16 is generally a 0.032 inch thick piece of conductive material, preferably copper or a copper alloy. In the preferred embodiment, the fusible link 16 is made of the same conductive metal, i.e. copper, as the first and second cables 12,14. Notwithstanding the above, the fusible link 16 can be made of any suitable conductive metal which can form a fuse element that, when properly configured, melts to open the circuit under both short circuit conditions and under prolonged modest overload conditions.

Further, in both of the above-described preferred embodiments, a plurality of apertures or cutouts 44 extend through the link segment 17 of the fusible link 16. The apertures 44 create regions of high electrical resistance. Additionally, a second conductive material 48 having a lower melting temperature than the material of the fusible link 16 may be distributed on the fusible link 16 adjacent the apertures 44 to lower the melting temperature of the fusible link. Preferably a tin or tin/lead spot 48 is distributed on the upper or first surface 36 of the fusible link 16 for such purposes.

Figure 3:
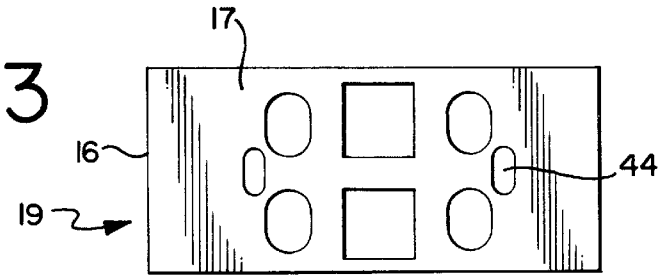
FIG. 3 is a top plan view of one fusible link of the present invention.

The fusible link 16 is manufactured by conventional stamping and bending techniques. The method of manufacturing the fusible links 16 described above generally begins with providing a substantially planar strip of conductive material 19 having a first surface 36 and a second surface 38. Next, the apertures 44 are created in the strip of conductive material as shown in FIG. 3. The apertures 44 extend through the strip from the first surface 36 thereof, to the second surface 38 thereof. The apertures 44 may be created by any method, including stamping, punching, and with the use of lasers and chemicals.

The next step includes creating members 40,42 transverse to the first and second surface 36,38 of the link segment 17. Generally, this is accomplished by bending a portion of the conductive material adjacent the first and second sides 39,41 of the link segment 17. In the preferred embodiments, a portion of the material at the first side 39 of the strip of conductive material is bent at an angle to the first surface 36 to create the first transverse member 40, and a portion of the material at the second side 41 of the strip of conductive material is bent at an angle to the first surface 36 to create the second transverse member 42. The angle may be positive or negative, as shown in FIG. 7. In the embodiment of FIG. 7, the first transverse member 40 extends roughly 90° from the first surface 39, while the second transverse member 42 extends roughly −90° from the first surface 39.

Additionally, as shown in both FIGS. 4 and 6, the first and second transverse members 40,42 extend in a direction from the first end 39 of the fusible link to the second end 41 of the fusible link. Notwithstanding the preferred embodiment which includes bent sides, the transverse members 40,42 may be additional material connected to the link segment 17 of the fusible link 16. Further, the transverse members 40,42 may extend the entire length from the first end 30 of the fusible link 16 to the second end 32 of the fusible link 16 as shown in FIG. 4, or the transverse members 40,42 may extend along a portion of the sides 39,41 of the fusible link 16 as illustrated in FIG. 6. As shown in FIG. 1, if the transverse members 40,42 extend the entire length from the first end 30 to the second end 32 of the fusible link 16, they provide additional retaining means for the cables 12,14.

Figure 2:
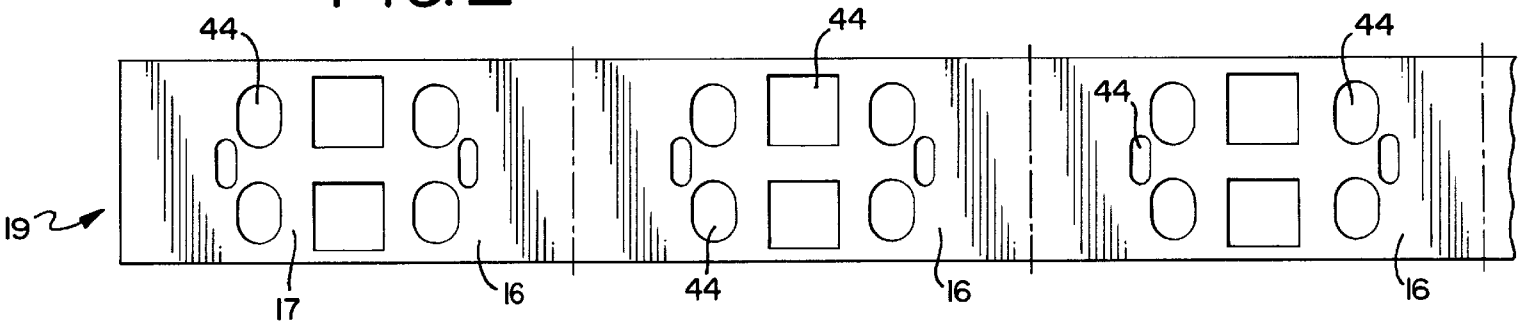
FIG. 2 is a top plan view of a strip of conductive material utilized to create a plurality of fusible links of the present invention.

As shown in FIG. 2, the method of manufacturing the fusible links 16 allows for manufacturing a plurality of links simultaneously. As such, a strip of conductive material is provided 19. The strip is much longer than a single fusible link 16. The process commences as if a single fusible link 16 were being manufactured. As such, a plurality of apertures 44 are created in the strip of material 19. The apertures 44 are located in appropriate clusters for each resulting fusible link. After the strip 19 has the appropriate apertures therein, the strip is diced into individual link segments 17. The strip may be diced lengthwise or widthwise, depending on the configuration of the fusible link. Each diced link segment 17 from the long strip 19 shown in FIG. 2 becomes an individual link segment 17 as shown in FIG. 3. Once the link segments 17 are diced, the transverse members 40,42 are created as described above.

Additionally, a second conductive material 48 may be placed on one of the first and second surfaces 36,38 of the fusible link. As shown in FIG. 1, the second conductive material 48 is preferably located adjacent one of the apertures 44.

The first end portion 24 of each of the first and second cables 12,14 is electrically connected to the fusible link 16 adjacent the opposing first and second ends 30,32 of the fusible link, respectively. The first end portion 24 of the first cable 12 is electrically connected to the fusible link 16 adjacent the first end 30 of the fusible link, thereby creating a first connection point. Similarly, the first end portion 24 of the second cable 14 is electrically connected to the fusible link 16 adjacent the second end 32 of the fusible link, thereby creating a second connection point. As such, the fusible link 16 is located between and electrically connects the first and second cables 12,14. The means for electrically connecting the cables 12,14 to the fusible link 16 is preferably accomplished by brazing the cable to the fusible link. Other means, including compressing, welding, soldering and sonic welding, can be employed as well. As shown in FIG. 1, the first cable 12 and the second cable 14 are preferably connected to the top surface of the fusible link 16, and between the transverse sides 40,42 thereof.

As shown in FIG. 1, the protective housing 18 comprises a pair of housing members. Preferably, the pair includes a first housing member 60 and a second housing member 62. Each housing member 60,62 is generally made of a heat resistant plastic material. The protective housing 18 itself, as well as the first and second housing members 60,62 of the protective housing, each have a first end portion 72, a second end portion 74, and an intermediate section 76 therebetween. The first end portion 72 of each housing member has a first cavity 78, the second end portion 74 of each housing member has a second cavity 80, and the intermediate section 76 of each housing member has an intermediate cavity 82. The intermediate cavity 82 of the first and second housing members has a greater volume than that of the first and second cavities 78,80 of the first and second housing members. The protective housing 18 securably engages the first and second cables 12,14, to prevent both axial and rotational movement of the cables 12,14. As such, a much more rigid assembly is provided to prevent loosening or breaking of the connection between the first and second cables 12,14 or wires and the fusible link 16. Additionally, features of the housing 18 provide for increased protection for the components within the housing 18 from outside elements.

The first and second housing members 60,62 each have a shoulder 68 and groove 70 therein. One shoulder 68 is adjacent a side of each of the first and second housing members 60,62. Similarly, one groove 70 is adjacent the opposing side of each of the first and second housing members 60,62. The shoulder 68 that extends from the first housing member 60 mates with the groove 70 in the second housing member 62 when the first and second housing members 60,62 are coupled, and the shoulder 68 that extends from the second housing member 62 mates with the groove 70 in the first housing member 60 when the first and second housing members 60,62 are coupled. The grooves 70 and shoulders 68 not only operate as a locating means for the first and second housing members during coupling thereof, but the mated shoulders 68 and grooves 70 also provide a seal area about the sides of the protective housing 18.

The first and second housing members 60,62 also have interconnecting members 64,66 which mate to assist in locating the first and second housing members 60,62 together for coupling thereof The interconnecting members comprise a post 64 and a mating aperture 66. Each housing member 60,62 has a post 64 at the first and second end portions 72,74 of each respective housing member 60,62. The posts are adjacent one of the sides of the respective housing member 60,62. Additionally, each housing member 60,62 has an aperture 66 at the first and second end portions 72,74 of each respective housing member 60,62. The apertures 66 are adjacent the opposing side of the respective housing member 60,62 as that of the posts 64. Accordingly, the post 64 at the first end portion 72 of the first housing member 60 mates with the aperture 66 at the first end portion 72 of the second housing member 62, the post 64 at the second end portion 74 of the first housing member 60 mates with the aperture 66 at the second end portion 74 of the second housing member 62, the post 64 at the first end portion 72 of the second housing member 62 mates with the aperture 66 at the first end portion 72 of the first housing member 60, and the post 64 at the second end portion 74 of the second housing member 62 mates with the aperture 66 at the second end portion 74 of the first housing member 60. When coupled, the protective housing 18 covers the fusible link 16 and portions of the first and second cables 12,14.

As shown in FIG. 1, when the first and second housing members 60,62 are coupled together to form the overall protective housing 18, the protective housing 18 can be said to have a first channel portion 84 at a first end 72 thereof which houses a portion of the first cable 12; a second channel portion 86 at the second end 74 thereof which houses a portion of the second cable 14; and, an intermediate channel portion 88 between and connecting the first channel 84 and the second channel 86 which houses the fusible link 16. The first channel portion 84 is comprised of the first cavity 78 of the first and second housing members 60,62, the second channel portion 86 is comprised of the second cavity 80 of the first and second housing members 60,62, and the intermediate channel portion 88 of the protective housing 18 is comprised of the intermediate cavities 82 of the first and second housing members 60,62. The individual channel portion 84,86,88 cooperate to form a continuous channel extending from the first end 72 of the protective housing 18 to the second end 74 of the protective housing 18. The intermediate channel 88 houses the fusible link 16. A portion of the intermediate channel 88 is spaced a distance away from the fusible link 16 to create a gap between the fusible link 16 and an interior wall of the intermediate channel 88.

The protective housing 18 further has a plurality of ribs 90,91 extending into the channel. As shown in FIG. 1, in the preferred embodiment, two first ribs 90 and two second ribs 91 extend from the protective housing 18 and into the channel at the first end portion 72 of the protective housing 18, and two first ribs 90 and two second ribs 91 extend from the protective housing 18 and into the channel at the second end portion 74 of the protective housing. More specifically, in the preferred embodiment a first rib 90 extends from the first housing member 60, at both the first and second end portions 72,74 thereof, and into the channel; and, a second rib 91 extends from the first housing member 60, at both the first and second end portions 72,74 thereof, and into the channel. Similarly, a first rib 90 extends from the second housing member 62, at both the first and second end portions 72,74 thereof, and into the channel; and, a second rib 91 extends from the second housing member 60, at both the first and second end portions 72,74 thereof, and into the channel.

The first and second housing members 60,62 have a longitudinal axis (L) which generally extends from the first end 72 of the respective housing member to the second end 74 of the respective housing member. The first ribs 90 of the first and second housing members 60,62 generally extend about a portion of the longitudinal axis (L) of the respective housing member 60,62. Accordingly, when the first and second housing members 60,62 are coupled to form the protective housing 18, the first ribs 90 extend axially from the protective housing 18. The second ribs 91 are transverse to the first ribs 90, and conversely, the first ribs 90 are transverse to the second ribs 91. In the preferred embodiment, the second ribs 91 extend substantially perpendicular to the first ribs 90. As such, in the preferred embodiment the second ribs 91 do not have to be at exact right angles to the first ribs 90.

Moreover, in the preferred embodiment the first housing member 60 and the second housing member 62 are identical components. Even though the protective housing 18 has been described as having a first housing member 60 and a second housing member 62, the protective housing 18 can be comprised of either two first housing members 60, or two second housing members 62, that is a pair of housing members. To mate the housing members, one housing member is rotated 180 degrees to allow the mating grooves/shoulders and posts/apertures to correspond.

The first and second ribs 90,91 at the first end portion 72 of the first and second housing members 60,62 contacts the protective covering 22 of the first cable 12 to grip and contain the first cable 12 at the first end portion 72, and the first and second ribs 90,91 at the second end portion 74 of the first and second housing members 60,62 contacts the protective covering 22 of the second cable 14 to grip and contain the second cable. Generally, the ribs 90,91 comprise a protrusion extending from the housing member. In the preferred embodiment, the ribs 90,91 have an apex for securely engaging the cable. Further, in the preferred embodiment the ribs 90,91 at the first end portion 72 extend from an interior wall of the first channel and the ribs 90,91 at the second end portion 74 extend from an interior wall of the second channel. When the two housing members 60,62 of the protective housing 18 are mated and firmly connected together, portions of the ribs 90,91 are indented into the insulative layer 22 of the cable. This allows the engaging ribs 90,91 to securely grip and contain the cable 12,14 such that the cable is not capable of movement with respect to the protective housing 18. Specifically, the first ribs 90 which extend about a portion of the longitudinal axis (L) of the protective housing 18 prevent rotational movement of the cables 12,14 with respect to the protective housing 18. And, the second ribs 91 which extend transversely to the first ribs 90 prevent axial movement of the cables (i.e., movement of the cables into and out of the protective housing). By having ribs that are transverse to other ribs, whether the transverse ribs are perpendicular to the axial ribs or not, any type of movement of the cable with respect to the protective housing is substantially eliminated. Preventing movement of the cable with respect to the protective housing assists in ensuring that the cable assembly will not fail at the connection points of the cables and the fusible links. Additionally, having transverse members 40,42 depending from the fusible link 16 further assists in prevent failure of the connection points. As such, the first cable 12, the protective housing 18, the fusible link 16, and the second cable 14 form a unitary element when the protective housing 18 is secured around the cable assembly.

The inside diameter of the first and second cavities 78,80, and thus of the formed channels 84,86 can be varied to accommodate different size cables. Additionally, the height of the ribs 90,91 may vary accordingly with the variation in the cavity diameter. For a 6 gauge cable the cavity diameter is approximately 0.266" and the height of the ribs are 0.032". For an 8 gauge cable the cavity diameter is approximately 0.182" and the height of the ribs are 0.032". For a 4 gauge cable the cavity diameter is approximately 0.310" and the height of the ribs are 0.032". Even though the cavity diameter and rib height can be varied, a small change in the size of the cable does not necessarily require a change in the cavity diameter of the housing. The parameters of the cavity 84,86 and ribs 90,91 are such that a certain size cavity can accommodate small increases and decreases in the diameter of the cable 12,14.

Once the first and second housing members 60,62 are mated around and over the fusible link 16 and portions of the first and second cables 12,14, the first and second housing members 60,62 are fixedly connected with rivets 93 which extend through apertures 94 in the housing members 60,62. In the preferred embodiment apertures 94 for rivet 93 are located adjacent each of the four corners of the protective housing 18. It should be known however, that the first and second housing members 60,62 could be fixedly connected by any other means, including adhesives, welding, or any other connecting means. By fixedly connecting the first and second housing members 60,62 together, the ribs 90,91 are maintained securely in the protective covering 22 of the cables 12,14 to maintain the cables in place. As such, the cable 12,14 and fusible link 16 are securely connected to the housing 18.

While the specific embodiments have been illustrated and described, numerous modifications come to mind without significantly departing from the spirit of the invention, and the scope of protection is only limited by the scope of the accompanying Claims.

We claim:

1. A fusible link for a cable assembly comprising:

a link segment having a first end and a second end, a first surface and a second surface, and a first side and a second side, wherein a first member extends from the first side of the link segment and a second member extends from the second side of the link segment, the first and second members being substantially planar and further being transverse to the link segment, and wherein the first end of the link segment is adapted to engage a first cable of the cable assembly and the second end of the link segment is adapted to engage a second cable of the cable assembly.

2. The fusible link of claim 1, wherein the first member extends in a first direction transverse from the link segment, and wherein the second member extends in substantially the same direction as the first member.

3. The fusible link of claim 1, wherein the first member extends in a first direction transverse from the link segment, and wherein the second member extends in substantially an opposite direction as the first member.

4. The fusible link of claim 1, wherein the first member and the second member extend adjacent the first surface of the link segment.

5. The fusible link of claim 1, wherein the first member extends adjacent the first surface of the link segment, and wherein the second member extends adjacent the second surface of the link segment.

6. The fusible link of claim 1, wherein the first and second members extend substantially perpendicular to the first surface of the link segment.

7. The fusible link of claim 1, wherein the link segment is substantially planar.

8. The fusible link of claim 7, wherein a plurality of apertures extend through the link segment.

9. The fusible link of claim 7, wherein the fusible link is made of a first conductive material, and wherein a second conductive material is deposited on the link segment, the second conductive material having a lower melting temperature than the first conductive material.

10. The fusible link of claim 1, wherein the fusible link is made of a conductive material that is the same conductive material as the first and second cables.

11. The fusible link of claim 1, wherein the fusible link is made of a conductive material that is an alloy of the conductive material of the first and second cables.

12. A fusible link for a cable assembly, comprising:

a link segment having a first member extending transversely from the link segment, and a second member extending transversely from the link segment, the link segment adapted to be electrically connected to first and second cables of the cable assembly, wherein the link segment has a first end and a second end, and wherein the first and second members extend adjacent the first end to adjacent the second end.

13. The fusible link of claim 12, wherein the link segment has a first surface and a second surface, and a first side and a second side, wherein the first member extends from the first surface of the link segment, and wherein the second member extends from the second surface of the link segment.

14. The fusible link of claim 13, wherein the first member extends from the first surface adjacent the first side thereof, and wherein the second member extends from the second surface adjacent the second side thereof.

15. The fusible link of claim 12, wherein the link segment a first surface and a second surface, and a first side and a second side, and wherein the first member and the second member extend from the first surface of the link segment.

16. The fusible link of claim 15, wherein the first member extends from the first surface adjacent the first side thereof, and wherein the second member extends from the first surface adjacent the second side thereof.

17. The fusible link of claim 12, wherein the first member extends in a first direction from the link segment, and wherein the second member extends in a second direction from the link segment.

18. The fusible link of claim 17, wherein the second direction is substantially the same direction as the first direction.

19. The fusible link of claim 17, wherein the second direction is substantially the opposite direction as the first direction.

20. The fusible link of claim 12, wherein a plurality of apertures extend through the link segment.

21. A method of manufacturing a fusible link for a cable assembly comprising the steps of:

providing a substantially planar strip of conductive material having a first surface and a second surface, and a first end and a second end;

creating an aperture in the conductive material, the aperture extending from the first surface to the second surface;

creating members transverse to the first and second surface of the conductive material, the transverse members extending from substantially the first end to the second end.

22. The method of claim 21, further comprising the step of dicing the strip into individual fusible links prior to creating the transverse members.

23. The method of claim 21, further comprising the step of adding a second conductive material on one of the first and second surfaces, the second conductive material having a lower melting temperature than the first conductive material, the second conductive material being added adjacent the aperture in the conductive material.

24. The method of claim 21, wherein the strip of conductive material has a first side and a second side, wherein the first side of the strip of conductive material is bent at an angle to the first surface to create a first transverse member, the first transverse member extending in a direction from the first end to the second end, and wherein the second side of the strip of conductive material is bent at an angle to the first surface to create a second transverse member, the second transverse member extending in a direction from the first end to the second end.

25. The method of claim 21, further comprising the step of connecting the first end of the fusible link to a first cable and connecting the second end of the fusible link to a second cable.

26. The method of claim 21, further comprising the step of creating a plurality of apertures in the conductive material, the apertures extending from the first surface to the second surface of the conductive material.

27. A fusible link for a cable assembly, comprising:

a link segment having a first surface and a second surface, and a first side and a second side, the link segment further having a first member extending transversely from the link segment and a second member extending transversely from the link segment, wherein the first member extends adjacent the first surface of the link segment, and wherein the second member extends adjacent the second surface of the link segment, the link segment adapted to be electrically connected to first and second cables of the cable assembly.

28. The fusible link of claim 27, wherein the first member extends from the first side of the link segment and wherein the second member extends from the second side of the link segment.

29. The fusible link of claim 27, wherein the first member extends in a first direction from the link segment, and wherein the second member extends in a second direction from the link segment.

30. The fusible link of claim 29, wherein the second direction is substantially the opposite direction as the first direction.

* * * * *